US009365379B2

(12) United States Patent
Mazzaccherini et al.

(10) Patent No.: US 9,365,379 B2
(45) Date of Patent: Jun. 14, 2016

(54) REWINDING MACHINE AND METHOD FOR PRODUCING LOGS OF WEB MATERIAL

(75) Inventors: Graziano Mazzaccherini, Porcari (IT); Romano Maddaleni, Bientina (IT); Franco Montagnani, Palaia (IT)

(73) Assignee: Fabio Perini S.p.A., Lucca (IT)

( * ) Notice: Subject to any disclaimer, the term of this patent is extended or adjusted under 35 U.S.C. 154(b) by 205 days.

(21) Appl. No.: 14/110,328

(22) PCT Filed: Apr. 4, 2012

(86) PCT No.: PCT/EP2012/056231

§ 371 (c)(1), (2), (4) Date: Oct. 23, 2013

(87) PCT Pub. No.: WO2012/136735

PCT Pub. Date: Oct. 11, 2012

(65) Prior Publication Data

US 2014/0054407 A1 Feb. 27, 2014

(30) Foreign Application Priority Data

Apr. 8, 2011 (IT) ..... FI2011A0061

(51) Int. Cl.
*B65H 19/22* (2006.01)
*B65H 19/26* (2006.01)

(52) U.S. Cl.
CPC ..... *B65H 19/26* (2013.01); *B65H 19/22* (2013.01); *B65H 19/2276* (2013.01); *B65H 19/267* (2013.01); *B65H 2406/33* (2013.01); *B65H 2408/235* (2013.01)

(58) Field of Classification Search
CPC ..... B65H 19/22; B65H 19/26; B65H 19/2276
USPC ..... 242/532.2, 541.2, 542.1
See application file for complete search history.

(56) References Cited

U.S. PATENT DOCUMENTS

| | | | | |
|---|---|---|---|---|
| 4,487,377 | A | 12/1984 | Perini | |
| 5,402,960 | A | 4/1995 | Oliver et al. | |
| 5,505,402 | A | 4/1996 | Vigneau | |
| 5,538,199 | A | 7/1996 | Biagiotti | |
| 5,603,467 | A | 2/1997 | Perini et al. | |
| 5,639,046 | A * | 6/1997 | Biagiotti | 242/541.2 |
| 5,839,680 | A | 11/1998 | Biagiotti | |
| 5,979,818 | A | 11/1999 | Perini et al. | |
| 6,565,033 | B1 | 5/2003 | Biagiotti | |

(Continued)

FOREIGN PATENT DOCUMENTS

| | | |
|---|---|---|
| EP | 0611723 B1 | 9/1997 |
| WO | 94-29205 A1 | 12/1994 |

(Continued)

*Primary Examiner* — Sang Kim
(74) *Attorney, Agent, or Firm* — Breiner & Breiner, L.L.C.

(57) ABSTRACT

The machine includes a first winding roller and a concave plate extending around the first winding roller. The first winding roller and the concave plate define a feed channel of the web material. Upstream of the concave plate there is arranged a moving member including a pinching surface cooperating with the first winding roller to pinch the web material against the first winding roller. The moving member is arranged and controlled to pinch the web material against the surface of the first winding roller and decelerate the web material between the moving member and the surface of the first winding roller, causing a leading edge to wind around itself to form a winding nucleus of a log.

31 Claims, 14 Drawing Sheets

(56) References Cited

U.S. PATENT DOCUMENTS

| | | | | |
|---|---|---|---|---|
| 6,752,344 | B1 | 6/2004 | Biagiotti | |
| 6,752,345 | B2 | 6/2004 | Betti et al. | |
| 7,101,587 | B2 * | 9/2006 | Gingras et al. | 427/177 |
| 2003/0025029 | A1 | 2/2003 | Gingras et al. | |
| 2009/0272835 | A1 | 11/2009 | Benvenuti et al. | |

FOREIGN PATENT DOCUMENTS

| | | | |
|---|---|---|---|
| WO | 03-004388 | A2 | 1/2003 |
| WO | WO 2011-104737 | A1 | 9/2011 |

* cited by examiner

L
3
3A
28
5A
Lc
5
21A
21C
23
21
23A
21B
27
N
IIIA

L
5
5A
3
3A
28
21A
21C
23
21
23A
21B
27
N

28
LT
27
f23
LA
23A
23
N 3
25B
28A
28
28C
28B
27B
27A
27
27C
25A
31
29
3C
3A
f3

5
5A
5B
3
3B
11
17B
17
23A
23B
L1
19
17A
17C
23
21A
21B
21C
21
f21
3A
f3

N 2
83
85
87
71
N
79
73
77
75
47
A
81
51
7
9
3
41
5
35
21
17
16
1
15
13
20

REWINDING MACHINE AND METHOD FOR PRODUCING LOGS OF WEB MATERIAL

TECHNICAL FIELD

The present invention relates to paper converting machines and in particular, machines for producing rolls of crepe paper or tissue paper.

STATE OF THE ART

Paper is normally produced by continuous machines which, through the delivery of a stock of cellulose fibers and water distributed from headboxes, generate a ply of cellulose material on a forming fabric, which ply is dried and wound in reels of large diameter. These reels are subsequently unwound and rewound to form logs of smaller diameter. The logs are subsequently divided into rolls of dimensions equal to the dimension of the end product. With this technique, rolls of toilet paper, kitchen towels or other tissue paper products are normally manufactured.

Winding of the logs normally takes place using cardboard winding cores, which are inserted into the rewinding machine and around which the log is formed. The cardboard core inside each log is cut together with the wound web material. Examples of rewinding machines of this type are described in U.S. Pat. No. 5,979,818 and in U.S. Pat. No. 4,487,377.

In other prior art rewinding machines, winding takes place around extractable and recyclable mandrels. An example of a rewinding machine for forming logs around tubular winding cores is described in U.S. Pat. No. 6,752,345. U.S. Pat. No. 6,565,033 describes a rewinding machine for winding logs of web material around winding mandrels divided into two portions, which are withdrawn from the log after winding has been completed.

Machines have also been manufactured, which perform winding of a log without the use of winding cores or mandrels. Examples of machines of this type are described in U.S. Pat. No. 5,538,199; U.S. Pat. No. 5,839,680; U.S. Pat. No. 5,505,402; U.S. Pat. No. 5,402,960; U.S. Pat. No. 6,752,344 and EP 0611723.

In particular, U.S. Pat. No. 5,839,680 and other patents from the same family disclose a machine wherein a log of web material is wound by forming a central nucleus that starts to wind around itself after the web material is severed upon completion of winding of a log. The web material is for this purpose pinched between a moving plate and a winding roller around which the web material is guided. The moving plate is pressed against the cylindrical surface of the winding roller so as to cause substantial deceleration of the web material and tearing thereof downstream of the pinching point. The moving plate has a convex portion, at which the web material is pinched by the plate against the outer surface of the winding roller, and a concave portion. The relative movement between the cylindrical surface of the winding roller and the surface of the plate causes the start of winding of a central nucleus of the subsequent log along the concave portion of the surface of the moving plate. The initial winding nucleus of the log is formed between the moving plate and the surface of the winding roller and advances along the moving plate, increasing in diameter, by rolling, until reaching a winding cradle defined between a plurality of winding rollers.

This prior art machine has noteworthy advantages, including that of forming the logs of web material without central winding core and without central hole, consequently enabling a large quantity of web material to be wound in a small space.

Despite the advantages mentioned above, these machines have some problems, including being difficult to fine tune, due to the critical nature of the initial step of severing the web material and starting winding of the central nucleus around itself. This difficulty is increased by the fact that the web material can vary in its characteristics, for example thickness, grammage and tensile strength, parameters which influence the initial step of severing of the web material and of winding the initial edge generated by tearing around itself.

U.S. Pat. No. 5,603,467 discloses a rewinding machine configured with two winding systems that enable the alternative production of logs with a central winding core and logs without a central winding core. This machine is particularly versatile, although the passage from one to the other of the two possible operating modes is complex and requires substantial operations to adapt it.

SUMMARY OF THE INVENTION

The subject matter of the invention is a rewinding machine capable of winding logs without a winding core and without a winding mandrel, which enables the drawbacks of prior art machines to be at least partly overcome.

The subject matter of the invention also relates to a new method of winding logs without a winding core and without a winding mandrel, which enables the supply of a product of higher quality with respect to the product obtainable with conventional machines.

In substance, according to a first aspect, the invention provides a rewinding machine for producing logs of web material, comprising a first winding roller and a concave plate extending around the first winding roller, with a concave surface facing the winding roller. The first winding roller and the concave plate define a feed channel of the web material. There is also provided a feed path of the web material extending along said channel and upstream of the concave plate. Moreover, there is provided a moving member which comprises a pinching surface cooperating with the first winding roller to pinch the web material against the lateral surface of the first winding roller. The moving member is arranged and controlled to pinch the web material against the surface of the first winding roller and decelerate the web material between the moving member and the surface of the first winding roller, causing a leading edge to wind around itself to form a winding nucleus of the second log. Once the step to form the initial nucleus of the new log between the moving member and the winding roller has started, the nucleus is transferred toward and into the channel, so as to continue winding and to advance along the channel, in contact with the concave surface of the concave plate arranged around the winding roller.

In this way, a machine is obtained in which the initial step to start winding the initial edge of each log around itself takes place by means of a moving member, different from the substantially stationary element (the concave plate) which then transfers the initial winding nucleus toward a winding cradle, for example formed by a cluster of winding rollers. The moving member is controlled so as to transfer the initial winding nucleus from the pinching area between the moving member and the roller toward the channel defined between the roller and the concave surface, facing the winding roller, of the concave plate.

Preferably, the height of the channel defined by the first winding roller and by the concave plate is gradually increasing from the inlet to the outlet, for example by providing a gradually increasing radius of curvature of the concave surface.

The web material is advantageously fed at a substantially constant speed. Substantially constant is intended as a speed that can vary for requirements linked to transitory steps, such as changing the parent reel of web material, but which does not require to be modified during the various steps of a same winding cycle, i.e. of formation of a log of web material.

Nonetheless, the speed of the web material can be modified locally. A local variation of the speed of the web material is a variation that involves a portion of the web material, for example in the section in which severing is to take place, without altering the overall winding speed.

Preferably, the moving member is arranged and controlled also to cause severing of the web material before the leading edge winds around itself after severing. Severing can advantageously take place as a result of the tension produced in the web material due to the local difference in speed produced by pinching by means of the moving member.

It would also be possible to use alternative or auxiliary means to cause or facilitate severing of the web material, such as a variation of the peripheral speed of the winding rollers, an air jet system acting on the web material between the point of pinching by the moving member and the completed log, or the like. In less advantageous embodiments the web material can be severed upstream of the pinch point, using the moving member only as means to start winding of the new log, and retaining the web material adhering to the first roller through a suction system or other suitable retaining systems.

In some advantageous embodiments the machine comprises a peripheral winding cradle, in which the log is transferred, after leaving the channel formed between the concave plate and the lateral surface of the first winding roller. The winding cradle comprises in general a series of moving members which, remaining in contact with the surface of the log, make it rotate to wind the web material. The moving members can comprise the aforesaid first winding roller. In advantageous embodiments the winding cradle is formed by a series or cluster of winding rollers, for example three winding rollers.

Preferably, the machine comprises a second winding roller arranged substantially parallel to the first winding roller so as to define a nip between the first winding roller and the second winding roller, said concave plate extending upstream of said nip and said feed path of the web material extending through said nip.

Downstream of the nip between the first and the second winding roller there can advantageously be provided a winding cradle formed by the first winding roller, by the second winding roller and by a third winding roller, preferably with a moving axis.

In advantageous embodiments, the moving member is controlled in such a manner that the pinching surface has a speed which is lower than the peripheral speed of the first winding roller when said pinching surface is pressed against said first winding roller. Lower speed can also be intended as a speed oriented in the opposite direction with respect to that of the winding roller (at least for an interval of time).

Advantageously, in some embodiments the concave plate defines an inlet edge cooperating with the moving member to form a transfer surface for rolling of the initial winding nucleus of the log from the moving member to said concave plate. For example, a comb shaped edge can be provided on the concave plate and a pinching surface between moving member and winding roller can be shaped with a series of projections which enter between the teeth of the comb shaped edge.

To facilitate the step of initial winding of the central nucleus of each new log, in some particularly advantageous embodiments of the invention the first winding roller comprises a lateral surface defining a longitudinal projection, extending parallel to the axis of said first winding roller and projecting radially with respect to the cylindrical surface of the first winding roller. The presence of a projection enables improved control of the web material severing and of the winding start of a new log and thus enables some important advantages to be obtained in terms of product quality and production speed. However, in simpler embodiments, the projection can be omitted and the first winding roller can have a substantially cylindrical lateral surface with a constant radius.

In some embodiments, adjacent to the longitudinal projection and behind it with respect to the direction of rotation, the first winding roller has a first lateral surface portion with a diameter gradually decreasing from said projection and terminating tangentially to a cylindrical surface defining a second portion of the lateral surface of the first winding roller, said cylindrical surface defining said second portion of the lateral surface of the winding roller having a substantially constant radius.

According to some embodiments, the first winding roller has a lateral surface formed by a first circular cylindrical portion with constant radius and by a second cylindrical portion with variable radius, extending parallel to the axis of the first winding roller, projecting with respect to said first cylindrical portion with constant radius.

Advantageously, along the longitudinal projection at least one suction aperture can be provided, preferably having the form of a slit extending parallel to the axis of the first winding roller and to said projection. The use of a suction system improves control of web material severing step and of starting winding of a new log. However, in simpler embodiments suction can be omitted.

To obtain a flexible machine, which is capable of producing not only logs without a core and central hole, but also conventional logs with a winding core or central hole formed by extracting an extractable winding core or winding mandrel, advantageously the concave plate can be movable between an operating position, in which it defines said feed channel of the web material, and an idle position, in which it is placed at a distance from the first winding roller. In combination with the concave plate, there can advantageously be provided, integrated in the same machine, a concave cradle positionable around the first winding roller, alternatively to the concave plate, said concave cradle having a radius of curvature greater than the radius of curvature of said concave plate. The radius of curvature can be constant, or variable. When the radius of curvature is variable, greater radius is intended as a radius of curvature that is always greater than the radius of the concave plate.

When required, the concave cradle can be mounted movable to alternatively take an operating position, in which it is arranged around the first winding roller to define a feed channel of the web material, and an idle position. The movement can be a movement of translation, of rotation or a combined movement.

According to a different aspect, the invention relates to a method for winding logs of web material without a winding core, comprising the steps of:

feeding a web material around a first winding roller;

winding a first log;

upon completion of winding of said first log, severing the web material forming a free trailing edge of the first log and a free leading edge of a second log;

winding around itself an initial portion of said web material, adjacent to said free leading edge, between the surface of the first winding roller and a moving member, forming an initial nucleus of said second log;

transferring said initial nucleus of the second log from the moving member to a channel defined between the first winding roller and a concave plate extending around said first winding roller;

feeding said initial nucleus of the second log by rolling it along said channel in contact with said concave plate and said first winding roller, continuing to wind the web material there around.

According to advantageous embodiments, the initial nucleus of the second log is then fed from the channel to a nip defined between the first winding roller and a second winding roller. From the nip the log being formed passes to a winding cradle, formed by moving members in surface contact with the log, such as a cluster of winding rollers comprising the first and the second winding roller and a third winding roller.

Preferably, the web material is severed by means of the same moving member, which starts forming the central nucleus of each new log.

In advantageous embodiments of the method according to the present invention, the web material is severed by the moving member as a result of deceleration of the web material in the pinching area between the moving member and the first winding roller.

Further advantageous features and embodiments of the method and of the machine according to the invention are described hereunder and in the appended claims, which form an integral part of the present description.

BRIEF DESCRIPTION OF THE DRAWINGS

The invention will be better understood by following the description and accompanying drawing, which shows practical non-limiting embodiments of the invention. More in particular, in the drawing.

DETAILED DESCRIPTION OF EMBODIMENTS OF THE INVENTION

Figure 1:
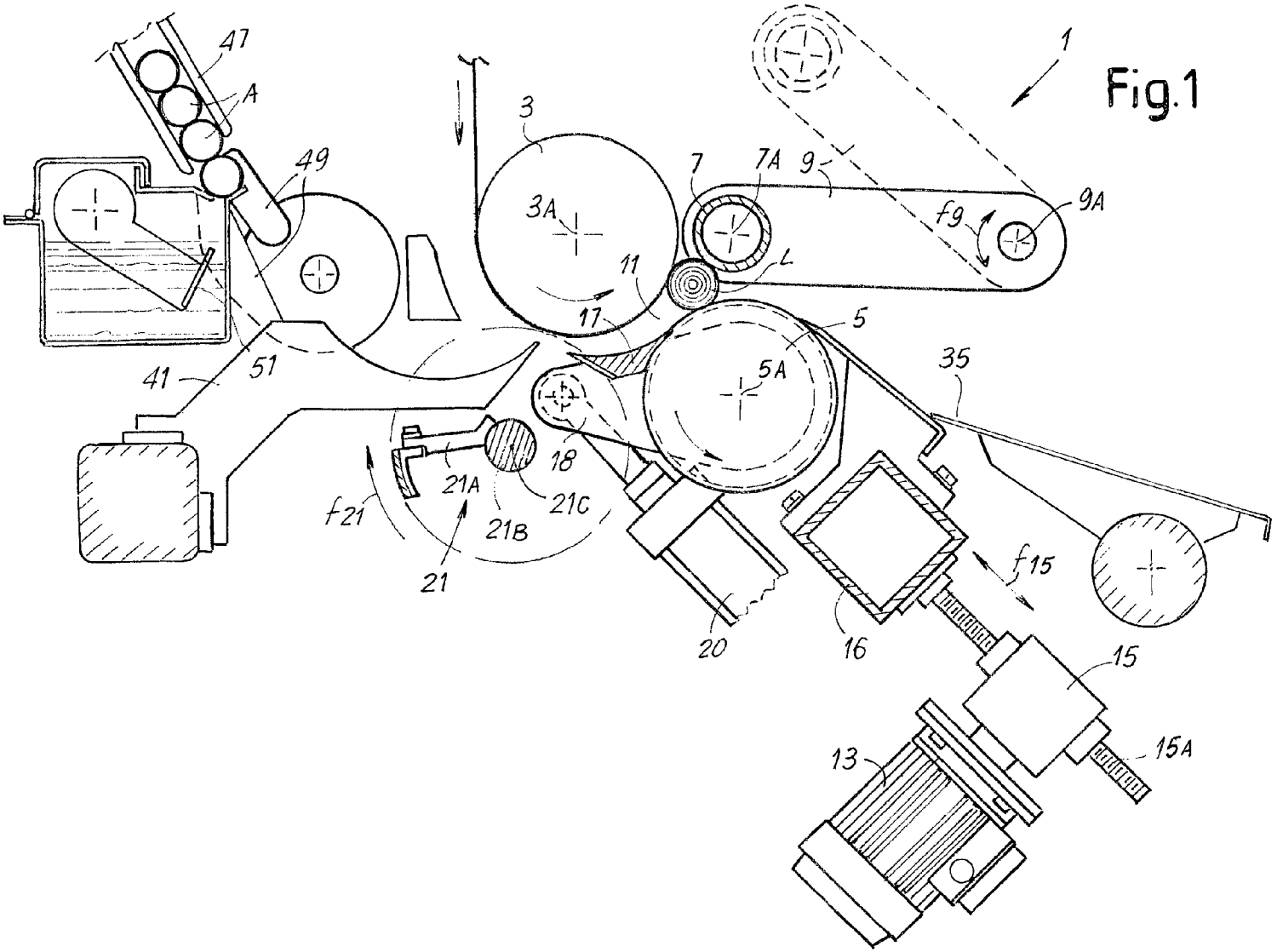
FIG. 1 shows a side view and partial section according to a vertical plane of a rewinder according to the invention, limited to the winding head, in a first operating arrangement and in a first embodiment.
Figure 2:
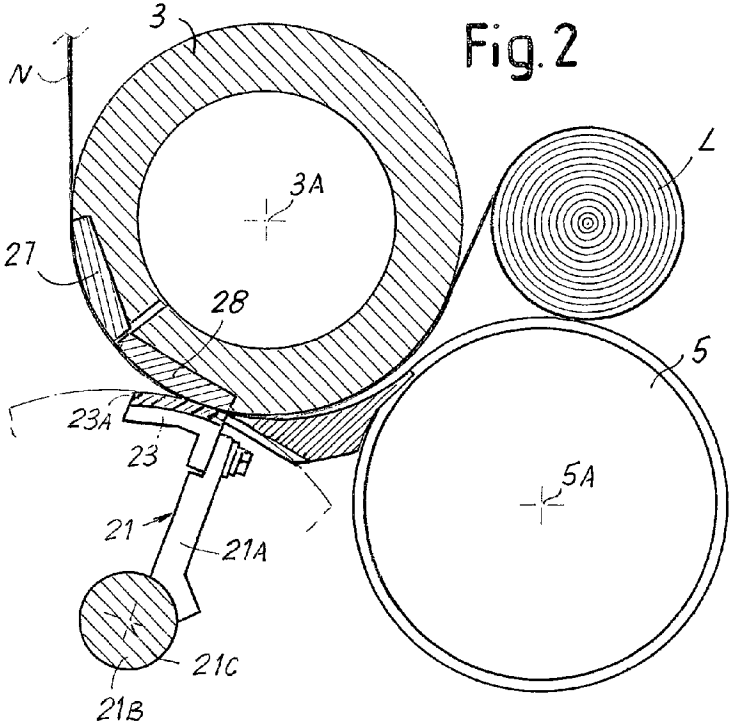

A first embodiment of a rewinder according to the invention is shown in FIGS. 1 to 9. FIG. 1 shows the main members of the rewinder, and in particular the members intended to feed the winding cores (employed when the machine is set to produce logs with a winding core), the winding rollers and the web material severing system.

The winding head is generically indicated with 1. In this embodiment, the winding head of the rewinding machine comprises a first winding roller 3 with a rotation axis 3A, a second winding roller 5 rotating about a rotation axis 5A and a third winding roller 7 rotating about a third rotation axis 7A. Between the two winding rollers 3 and 5 there is defined a nip 11 for passage of the web material.

In some embodiments the axis 3A of the first winding roller 3 is fixed with respect to the load bearing structure (not shown) of the machine. In other embodiments the axis 3A can be moving with respect to the load bearing structure.

In some embodiments the axis 5A of the second winding roller 5 is movable. In some embodiments the axis 5A is moved exclusively to pass from an operating mode, in which the rewinding machine produces logs without winding core, to an operating mode, in which the machine produces logs with winding core. In other preferred embodiments, the rotation axis 5A of the second winding roller 5 can be movable in a controlled manner also during each winding cycle of logs without winding core, as will be explained in greater detail below.

As will be apparent later on, the rewinding machine can be designed in such a manner as to produce not only logs without winding core or mandrel, but also logs wound on central winding cores or mandrels, which can have a variable diameter. The axis 5A of the second winding roller can be movable to adapt the machine to winding cores or mandrels of different diameters.

In some embodiments the roller 3 can have a moving axis 3A for the same reasons indicated above. In some embodiments both the winding rollers 3 and 5 can be movable and adjustable.

The third winding roller 7 is advantageously carried, for example, by a pair of arms 9 pivoting with a reciprocating movement according to the double arrow f9 about a pivoting axis 9A. The movement according to the double arrow f9 enables the third winding roller 7 to move toward or away from the first winding roller 3 and second winding roller 5 according to the diameter of the log L during the step of formation inside the winding cradle defined by the three winding rollers 3, 5 and 7.

FIG. 1 also shows an actuator, in this embodiment an electronically controlled electric motor 13 with a reducer 15, which controls rotation of a threaded bar 15A and therewith the movement, according to the double arrow f15, of a beam 16 that supports the second winding roller 5. By means of the actuator 13 it is therefore possible to move the winding roller 5 toward or away from the winding roller 3, modifying the dimension of the nip 11 between said winding rollers.

A concave plate 17 is arranged upstream of the nip 11. In some embodiments the concave plate 17 is supported by two pivoting arms 18 hinged around the rotation axis 5A of the second winding roller 5.

As shown in greater detail in the enlargements of FIGS. 2 to 5, in some embodiments the concave plate 17 has a concave surface 17A facing the cylindrical surface 3B of the first winding roller 3. Moreover, the concave plate 17 has teeth 17B which are inserted inside the circumferential grooves 5B provided on the cylindrical surface of the second winding roller 5, so as to define a substantially continuous surface for rolling of the log in the first winding step, as will be explained in greater detail below.

At the opposite end, the concave plate 17 is provided with a comb-shaped inlet edge 17C, as better illustrated in the detail of FIG. 4B and for the purposes described below.

Between the concave surface 17A facing the winding roller 3 of the concave plate 17 and the lateral surface 3B of the first winding roller 3 a feed channel 19 of the web material N is defined, which is guided around the first winding roller 3 and wound to form in subsequent winding cycles a plurality of logs.

The path of the web material N extends around the first winding roller 3 and inside the channel 19 and then through the nip 11 to feed the web material N inside the winding cradle formed by the winding rollers 3, 5 and 7.

A moving member 21 cooperates with the concave plate 17 and with the first winding roller 3, which moving member is configured and controlled to sever the web material and start winding of the central nucleus of a log without winding core.

In some embodiments the moving member 21 comprises a series of arms 21A integral with a central shaft 21B rotating about a rotation axis 21C. The arms 21A can be replaced by a single continuous beam which extends across the entire width of the machine.

The arms 21A or the continuous beam carry a series of pads 23. In some embodiments the pads 23 are provided with projections 23A with surfaces 23B preferably having a cylindrical shape, i.e. formed by portions of a cylindrical surface. The cylindrical surface must be intended in a geometric sense. It can preferably have a constant radius, with center coinciding with the rotation axis 21C of the moving member 21. In this case the surface of the projections 23A will therefore have a circular section. Nonetheless this is not strictly necessary. It would also be possible for the peripheral surface 23B of the projections 23A to have a variable radius and therefore a non-circular section.

Figure 4:
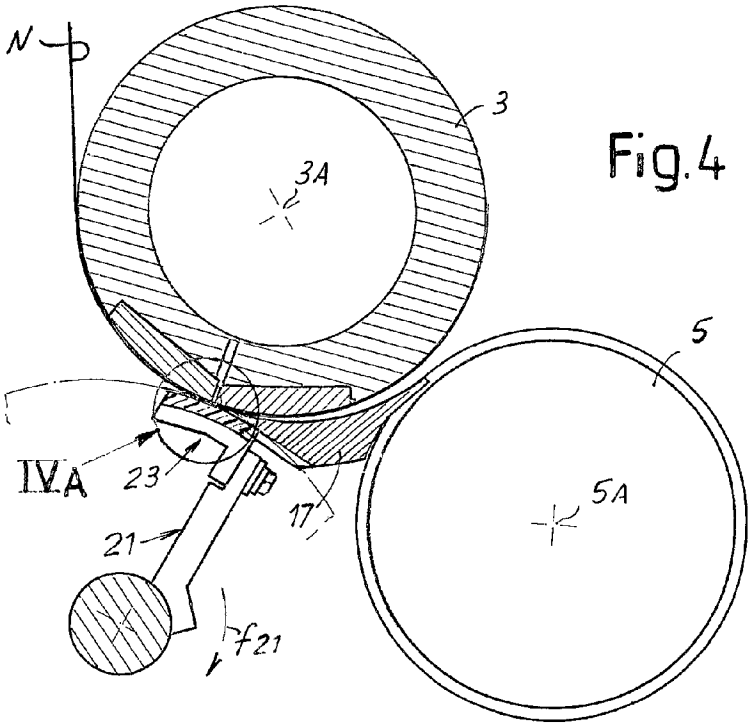
Figure 4A:
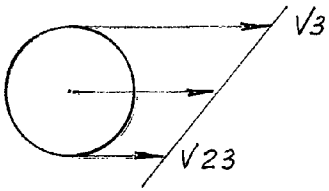
FIG. 4A shows an enlarged view of FIG. 4.
Figure 4A:
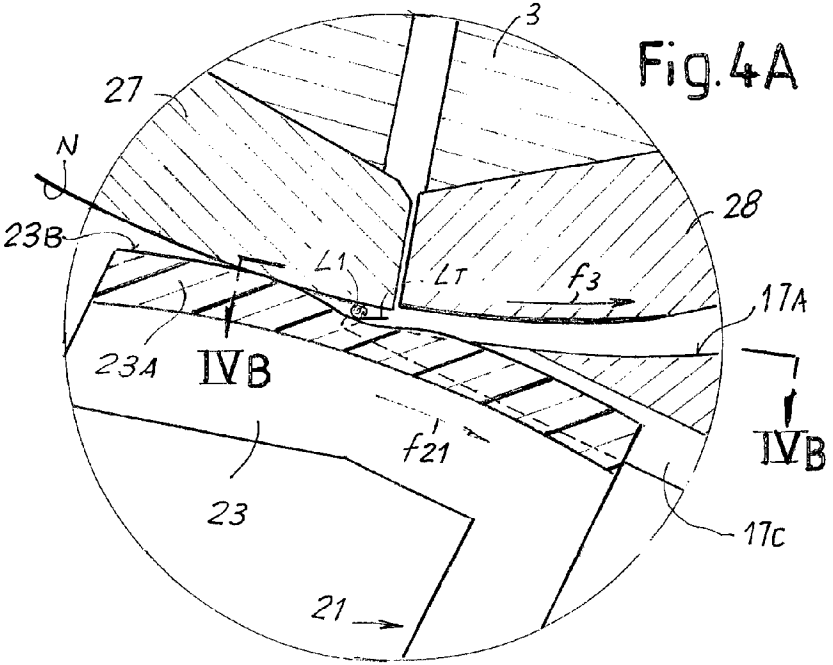
Figure 4B:
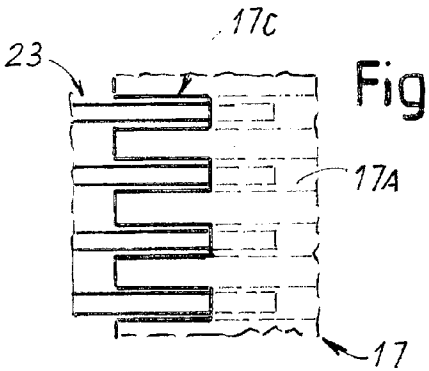
FIG. 4B shows an enlarged view according to the line $IV_B$-$IV_B$ of FIG. 4A.
Figures 5, 6:
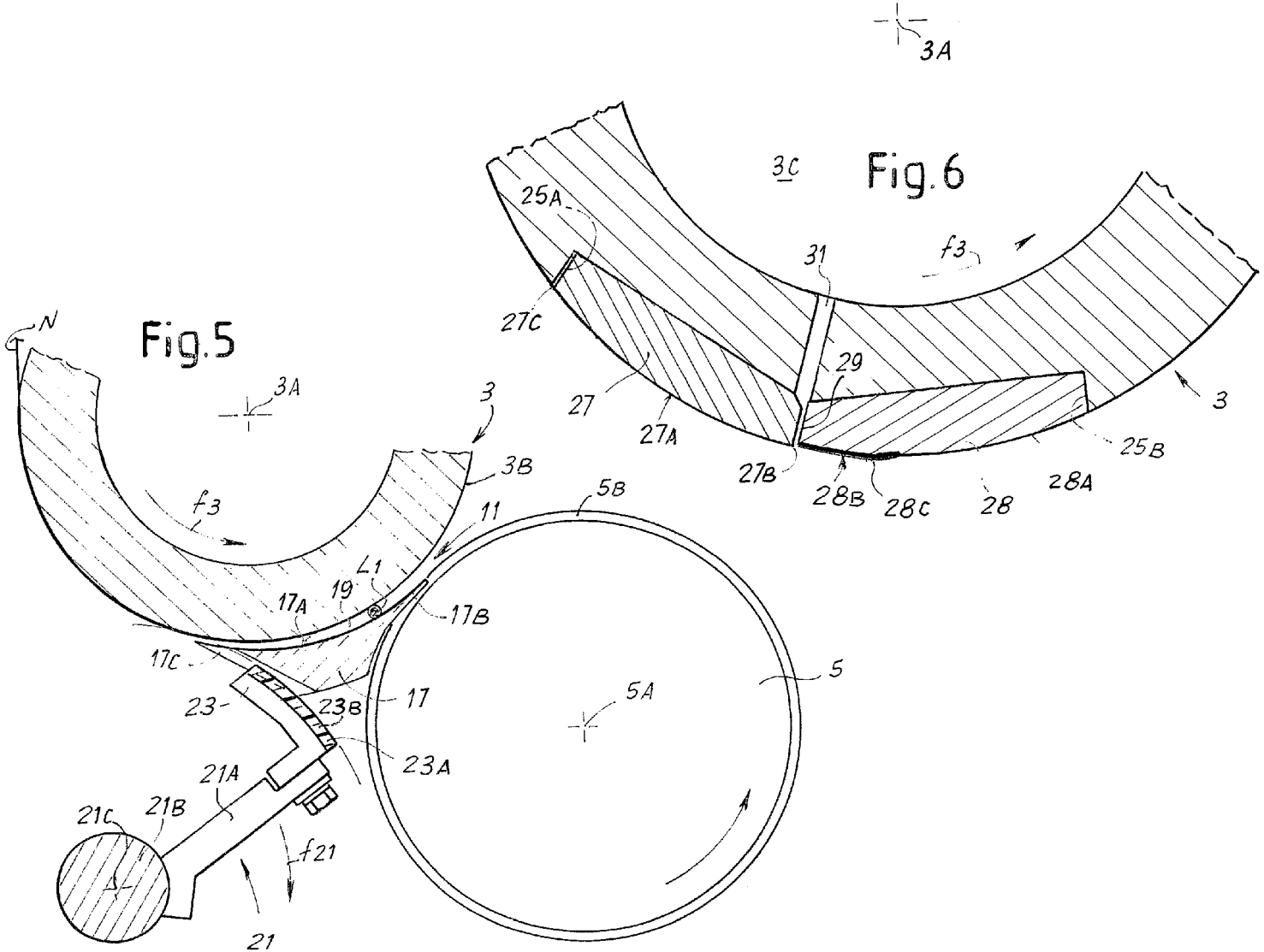
FIG. 5 shows an enlarged view of the winding area in a subsequent step to those of FIGS. 2, 3 and 4.
FIG. 6 shows an enlarged view of a portion of a first winding roller in a section according to a plane orthogonal to the rotation axis.

The projections 23A are arranged mutually spaced in such a manner as to be able to penetrate between the teeth of the comb shaped edge 17C of the concave plate 17 for the purposes better described below, as can be seen in the detail of FIG. 4B.

In some embodiments the surface 23B of the projections 23A can have a high coefficient of friction, for example obtained through surface machining of the material forming the projections 23A. In other preferred embodiments, the projections 23A are made of elastically yielding material, such as rubber, which can have per se a high coefficient of friction. High coefficient of friction is intended as a coefficient of friction greater than that of portions of the winding roller 3 on which the web material N is made to slide at least in some steps of the winding cycle, as will be clarified below.

Two seats indicated with 25A and 25B are provided on the first winding roller 3 (see in particular FIGS. 2, 3, 4 and 6). These seats have an extension preferably equal to the axial length of the winding roller 3. In these two seats 25A and 25B two blocks 27 and 28 can be housed, which are removable or interchangeable according to the operating mode in which the machine is required to operate. In FIGS. 2, 3, 4 and 6 the two blocks 27 and 28 housed in the seats 25A and 25B of the first winding roller 3 are designed in such a manner as to optimize operation of the machine in the operating mode of winding without central core.

In some advantageous embodiments, when they are mounted in their respective seats 25A and 25B, between the two blocks 27 and 28 is defined a suction slit 29 surfacing on the surface of the winding roller 3, in particular at the opposed edges of the blocks 27 and 28 which, once mounted, are at a slight distance from each other. Preferably, the suction slit 29 extends continuously for the entire useful length of the winding roller 3. The suction slit 29 can advantageously be in flow connection with one or more suction holes 31 provided in the thickness of the winding roller 3. The holes 31 place the slit 29 in connection with a compartment 3C inside the winding roller 3. Inside the compartment 3C a vacuum can be created, through means known per se, sufficient to generate a suction flow through the slit 29, at least in the exchange step, i.e. the step of completion of winding of a log and start of winding of the subsequent log. In other, less advantageous embodiments, the slit 29 can be discontinuous or replaced by holes distributed along a line, preferably parallel to the rotation axis 3A of the winding roller 3.

In some advantageous embodiments the block 27 has an external surface 27A, whose shape differs from the cylindrical shape with circular section of the part of lateral surface of the winding roller 3 not involved by the seats 25A and 25B housing the blocks 27 and 28.

More in particular, the surface 27A of the block 27 is a cylindrical surface with a variable radius (therefore with a non-circular section) varying from a maximum value at an edge 27B, at the suction slit 29, to the opposite edge 27C of the block 27. In substance, the block 27 has an external surface 27A with a diameter decreasing gradually from the maximum value at the edge 27B until connecting preferably in an approximately tangential manner with the part of cylindrical surface with constant radius of the winding roller 3 which is behind the block 27 with respect to the direction of rotation f3 of the winding roller 3.

The external surface of the block 28 can have two portions 28A, 28B, the first with constant diameter and the second (28B) with an increasing radius which forms a ramp ascending to a longitudinal point or projection 28C of maximum radius and from here continues with a constant radius. The portion 28B terminates at the suction slit 29 in opposed position with respect to the edge 27B formed by the block 27, with a diameter equal to or slightly less than the maximum diameter of the surface 27A.

The surface portion 28B can be made of a thin plate faced on the block 28, or also generated by chip removal machining of the surface of a block 28 which initially has a diameter larger than the final diameter.

The surface 27A of the block 27 is preferably treated in such a manner as to have a high coefficient of friction, for example through mechanical machining or through a suitable surface coating. Vice versa, the surface 28A, 28B of the block 28 is smooth, i.e. it has a coefficient of friction lower than the coefficient of friction of the surface 27A, for the purposes that will be explained below.

Preferably, in particular when the machine is designed to alternatively wind logs with and without central winding core, the remaining part of the surface of the winding roller 3 has annular bands with a low coefficient of friction alternated with annular bands with a high coefficient of friction.

The elements of the machine described above are used to produce logs L of web material wound without central core. The winding cycle is as follows.

In FIG. 1 the machine is shown in a winding step of a log L which is in contact with the three winding rollers 3, 5 and 7. In this phase and in this exemplary embodiment the second winding roller 5 has been moved away, by a movement imparted by the motor 13, from the first winding roller 3 to move the two points of contact between the log L and the first and second winding roller 3 and 5, respectively, away from each other. In other embodiments, the distance between centers of the rollers 3 and 5 is not varied during the winding cycle of the log, or is modified to a lesser extent.

Once the log L has reached the desired dimension, for example the desired diameter and/or the length of the wound material required, the moving member 21 is activated. This latter remains substantially fixed in the position shown in FIG. 1 for the whole of the winding cycle until action thereof is required for severing the web material N and starting winding the initial central nucleus of a second log around itself.

In this exemplary embodiment, the moving member 21 is made to rotate according to the arrow f21 in a direction opposite to the direction of rotation of the winding rollers 3, 5 and 7. The movement of the moving member 21 is controlled in such a manner as to pinch the web material N against the surface 28B of larger diameter of the block 28 when severing of the web material N is required upon completion of winding of the first log L, which is located in the winding cradle 3, 5 and 7. The movement is controlled in such a manner that the peripheral speed of the moving member 21, i.e. the speed of the surface 23B of the projections 23A of each pad 23 of the moving member 21, is concordant but lower, for example from 30 to 70% lower, than the peripheral rotation speed of the first winding roller 3 and therefore to the feed speed of the web material N. When the web material N is pinched between the surface 28B of the block 28 and the surface 23B of the projections 23A of the pads 23, it is locally decelerated, as the coefficient of friction of the surfaces 23B of the projections 23A of the pads 23 is greater than the coefficient of friction of the surfaces 28B of the block 28. As a result of pinching and of the speed difference between these members, in the pinching area the web material N takes the peripheral speed of the moving member 21, lower than the nominal feed speed of the web material N. As a result of the local deceleration of the web material N, the latter is severed, preferably along a perforation line produced on the web material N in a manner known per se, in a point comprised between the pinching area and the newly formed log L, whose peripheral speed continues to be substantially the same as the nominal feed speed of the web material.

Severing of the web material generates a trailing edge LC, which completes winding on the completed log L, and a leading edge LT (FIG. 3A) from which the new log originates.

As clarified above, the pressure between the pads 23 and the smooth surface with low coefficient of friction 28B of the block 28 and the speed difference between the members, between which the web material N is pinched, causes local slipping of the portion of the web material N adjacent to the leading edge LT which is formed as a result of severing. In the embodiment illustrated, to prevent this from causing loosening of the web material N upstream of the block 27, suction is activated through the suction slit 29, which retains the web material adhering to the winding roller 3. Suction can be activated with sufficient advance with respect to the instant in which the web material severing step starts. To make suction more timely and accurate, the interior of the winding roller 3 can be divided into two sectors, inside only one of which, delimited by radial barriers, a vacuum can be generated, thereby limiting the volume of air to be drawn up and the suction operation time.

Figure 3:
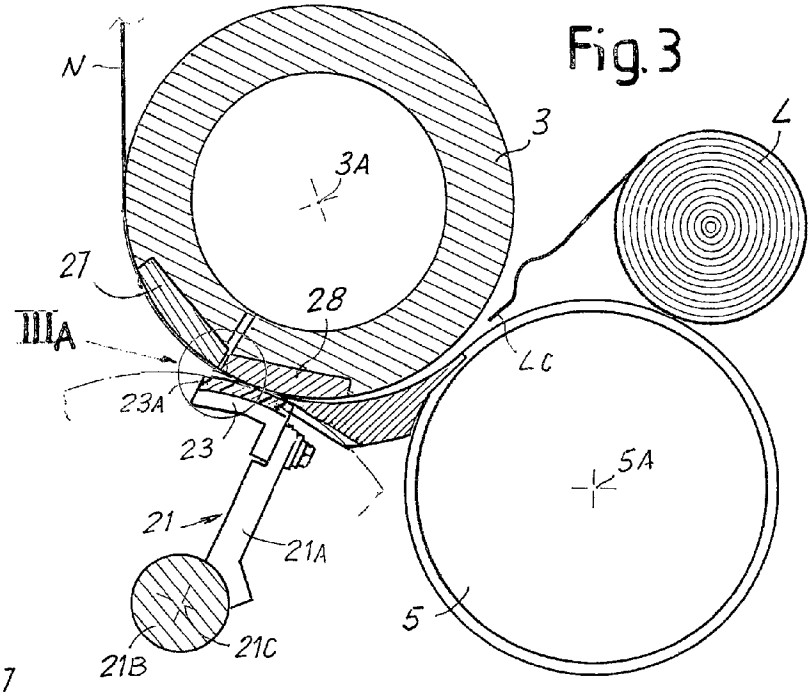
FIGS. 2, 3 and 4 show enlarged views of the winding area in the exchange step, i.e. the step of severing the web material upon completion of winding of a log and starting winding of a subsequent log.
Figure 3A:
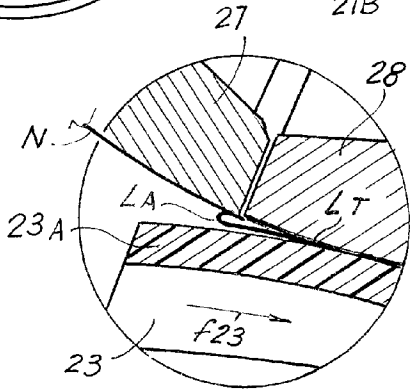
FIG. 3A shows an enlarged view of FIG. 3.

As a result of the speed difference between the winding roller 3 and the pads 23 of the moving member 21 and as a result of the difference in the coefficient of friction between the surfaces 23B (with higher coefficient of friction) and the surface 28B of the block 28 (with lower coefficient of friction), a loop LA of web material is formed in the area comprised between the pads 23 and the lateral surface of the winding roller 3 in the area of the blocks 27, 28, as can be seen schematically in FIG. 3A.

Continuing the relative movement between the roller 3 rotating at higher speed and the moving member 21 rotating at lower speed, mutual contact between these two members is transferred at the surface 27A of the block 27, behind the suction slit 29. Here, as a result of the greater coefficient of friction of the surface 27A of the block 27 and of the speed difference between the winding roller 3 and the pads 23, a central winding nucleus of the subsequent log, indicated with L1, starts to form. FIG. 4A shows a greatly enlarged schematic view of the area, in which winding of this central nucleus starts.

Preferably the projections 23A of the pads 23 are made of elastically yielding material, so that the pressure exerted by the nucleus L1 on the surface of the projections 23A causes local deformation of said projections at the initial winding nucleus L1 of the new log, as shown in FIG. 4A.

The new nucleus L1 advances along the feed path of the web material N around the first winding roller 3 at a speed that is determined by the peripheral speed $V_3$ of the winding roller 3 and by the peripheral speed $V_{23}$ of the pad 23 of the moving member 21. The central winding nucleus of the new log L1 then moves forward toward the surface 17A of the concave plate 17 at a speed that can be controlled by these two parameters. Due to the decreasing radius of the surface 27A of the winding roller 3, defined by the block 27, a gradually increasing space is formed to allow the increase of the diameter of the initial nucleus of the log L1. In fact, the latter advances along the surface of the winding roller 3 with a speed lower than the peripheral speed of said roller, so that it comes into contact with the roller 3 in a point that moves gradually back from the suction slit 29 toward the edge 27C of the block 27.

FIG. 4A shows the moment in which the new winding nucleus of the second log L1 also into contact comes with the comb-shaped structure 17C of the edge of the concave plate 17A. It can be understood from the representation of FIG. 4A that continuing the rotation movement of the roller 3 (arrow f3) and of the pad 23 (arrow f21) the initial nucleus of the new log L1 will be gradually transferred onto the concave surface 17A of the concave plate 17. After said transfer has been completed, the initial nucleus of the new log L1 will lose contact with the pads 23 of the moving member 21 and will continue to advance by rolling along the channel 19.

In the channel 19 the initial nucleus of the new log L1 is in contact on one side with the stationary surface 17A of the concave plate 17 and on the other with the cylindrical surface 3B of the winding roller 3. The center of the new central nucleus of the log L1, therefore, advances along the channel 19 at a speed that is equal to half the peripheral rotation speed of the winding roller 3, until reaching the nip 11.

The initial nucleus of the new log L1 is transferred without stress or discontinuity from the concave surface 17A of the concave plate 17 to the cylindrical surface of the second winding roller 5 as a result of penetration of the teeth 17B in the annular channels 5B described above.

From the nip 11 the diameter of the nucleus of the second log L1 will continue to increase until the nucleus comes into contact with the winding roller 7. This latter, which was previously raised to enable unloading of the completed log L along a surface 35, will be lowered again to come into contact with the new log L1 in the initial step of formation.

In some embodiments, during travel of the initial nucleus of the new log L1 along the channel 19, the dimension of the channel 19, i.e. the distance between the surface 17A of the concave plate 17 and the surface 3B of the winding roller 3, can gradually increase through controlled activation of the motor 13 to facilitate the increase of diameter of the initial nucleus of the new log L1. In some cases this gradual increase of diameter is given only by the increase of the radius of curvature of the surface 17A from the inlet area to the outlet area of the channel 19, as shown in the drawing, see for example FIG. 5.

However, the gradual increase of the height of the channel 19 due to the geometry of the surfaces is optimal only for a given value of the thickness of the wound web material N. If this thickness is greater than that for which the curvature of the concave surface 17A was designed, it may be useful or necessary to gradually increase the height of the channel 19 by moving the winding roller 5 away from the winding roller 3 under the control of the actuator 13, during travel of the initial winding nucleus of the second log L1.

It can be understood from the above that by using a moving member 21 to perform severing of the web material and to start winding the new nucleus of the log L1 in combination with the surface 17A of the concave plate 17, it is possible to optimize the various steps of the exchange cycle, i.e. of that operating part of the winding cycle during which the web material is severed and a new log L1 is started.

The rewinding machine of FIGS. 1 to 9 comprises, in addition to the members described above, also further mechanical members that enable the machine to pass from an operating mode for producing logs without central core, according to the method described above, to the production of logs with winding core. It must be understood that winding core is intended both as a tubular core destined to remain inside the log and if necessary be cut together with it during severing of the log into single rolls, and also as an extractable and recyclable core or mandrel. In the second case the logs manufactured by the machine will have no winding core (as this is extracted after winding, but will be provided with an axial hole.

Figure 7:
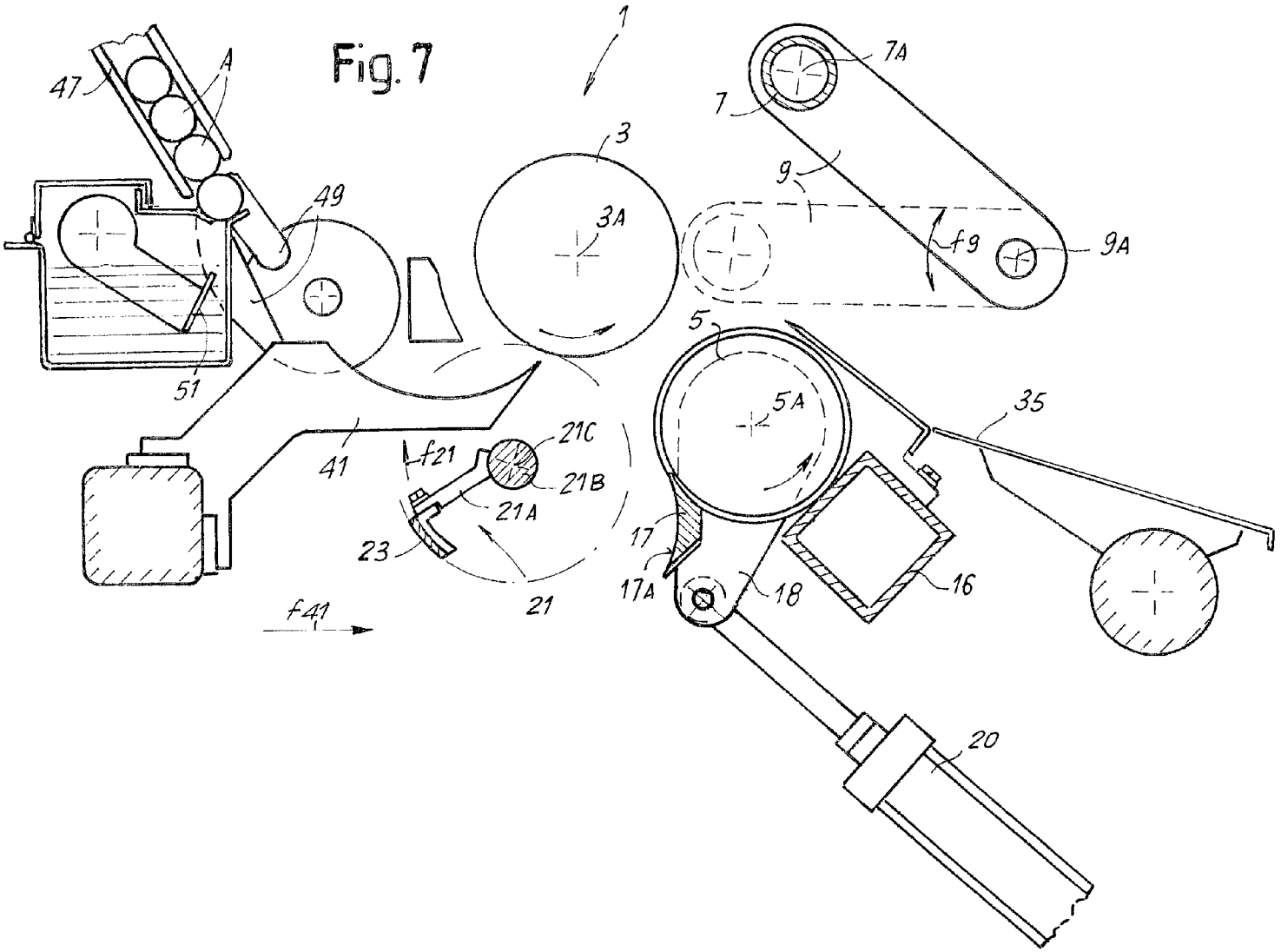
FIG. 7 shows the rewinding machine of FIG. 1 in a step of transition from a first operating mode of winding without a core to a second operating mode of winding about a winding core or a winding mandrel.
Figure 8:
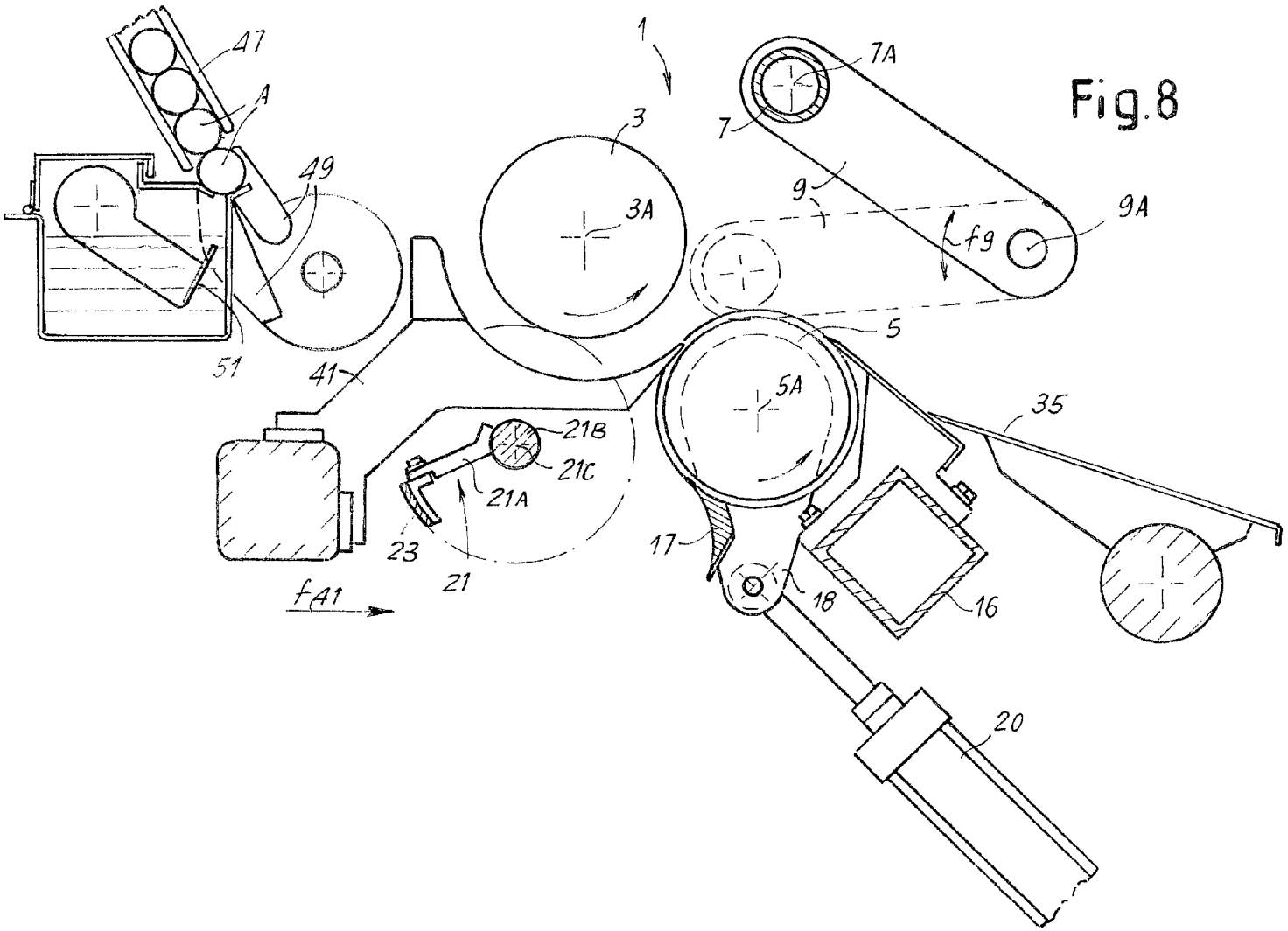
FIG. 8 shows a view similar to FIG. 7 with the rewinding machine in the second operating mode.

Passage of the rewinding machine from one operating arrangement to the other is illustrated in particular in FIGS. 7 and 8.

In some embodiments the rewinding machine 1 is provided for this purpose with a concave cradle 41 which, when the rewinding machine is in the arrangement for producing logs without winding core, is withdrawn with respect to the winding area (FIG. 1). The concave cradle 41 is in actual fact preferably formed by a series of mutually parallel shaped plates, only one of which is visible in the drawing and the others being superimposed thereon. The various shaped plates all have a concave edge forming a concave surface for rolling of the winding cores.

When the rewinding machine is required to pass from the production of logs without winding core to the production of logs wound around a winding core or mandrel, the concave plate 17 is moved away, for example through a movement of rotation of the arms 18, in the position shown in FIG. 7, at a distance from the cylindrical surface of the first winding roller 3. The movement of oscillation or rotation of the arms 18 can be controlled by a piston-cylinder actuator 20 (FIG. 7).

Besides moving the concave plate 17 away from winding roller 3, the winding roller 5 is also distanced from the winding roller 3, increasing the dimension of the nip 11 between the two winding rollers 3 and 5. The concave cradle 41 is inserted in the volume or free space thus generated. In the example shown, the concave cradle 41 is translated according to the arrow f41, for example by moving a supporting beam 43 of said concave cradle 41, which for this purpose is mounted on guides (not shown). FIG. 8 shows the final operating position of the concave cradle 41 which enables operation of the rewinding machine for producing logs with winding core.

Besides the movements described above, it may be useful to substitute the two interchangeable blocks 27, 28 with two inserts having a cylindrical external surface with circular section with a radius equal to the radius of the remaining lateral surface of the winding roller 3. Advantageously, each one of the two blocks, which are used for operation with winding cores or mandrels, has a surface divided into bands or strips alternatively with low and high coefficient of friction, so that once mounted on the winding roller 3, the latter has a cylindrical surface with a substantially constant radius divided into annular bands with a low coefficient of friction and annular bands with a high coefficient of friction.

The winding cores A are fed along a feeder 47. Single winding cores A are picked up by a core inserter 49 after a longitudinal line of glue has been applied thereto by a glue applicator 51. The members 47, 49 and 51 are known per se. The machine in this arrangement has substantially the same structure and operation as that described in U.S. Pat. No. 5,979,818 and therefore the operating cycle will not be described in detail.

In the winding mode without central core the moving member 21 performs the function of severing the web material and starting winding the nucleus of the new log L1, until it is transferred into the channel 19 between the stationary concave plate 17 and the winding roller 3. Vice versa, in the arrangement for producing logs with central winding core, the same moving member 21 is again used to sever the web material, but winding starts on the central core and the member 21 does not perform any function in relation to this action, except for an optional effect of accompanying the leading edge LT toward the new winding core A that is inserted into the channel formed between the winding roller 3 and the cradle 41 upstream (with respect to the direction of feed of the web material N) of the moving member 21.

In a manner known per se, the interaction between the concave cradle 41 and the moving member 21 is permitted by the fact that the former has a comb shaped structure formed by a plurality of parallel plates. In this way, the pads 23 of the moving member 21 can pass between adjacent plates and enter the feed channel of the winding cores A formed between the concave surface 41A of the cradle 41 and the cylindrical surface 3B of the winding roller 3.

Figure 9:
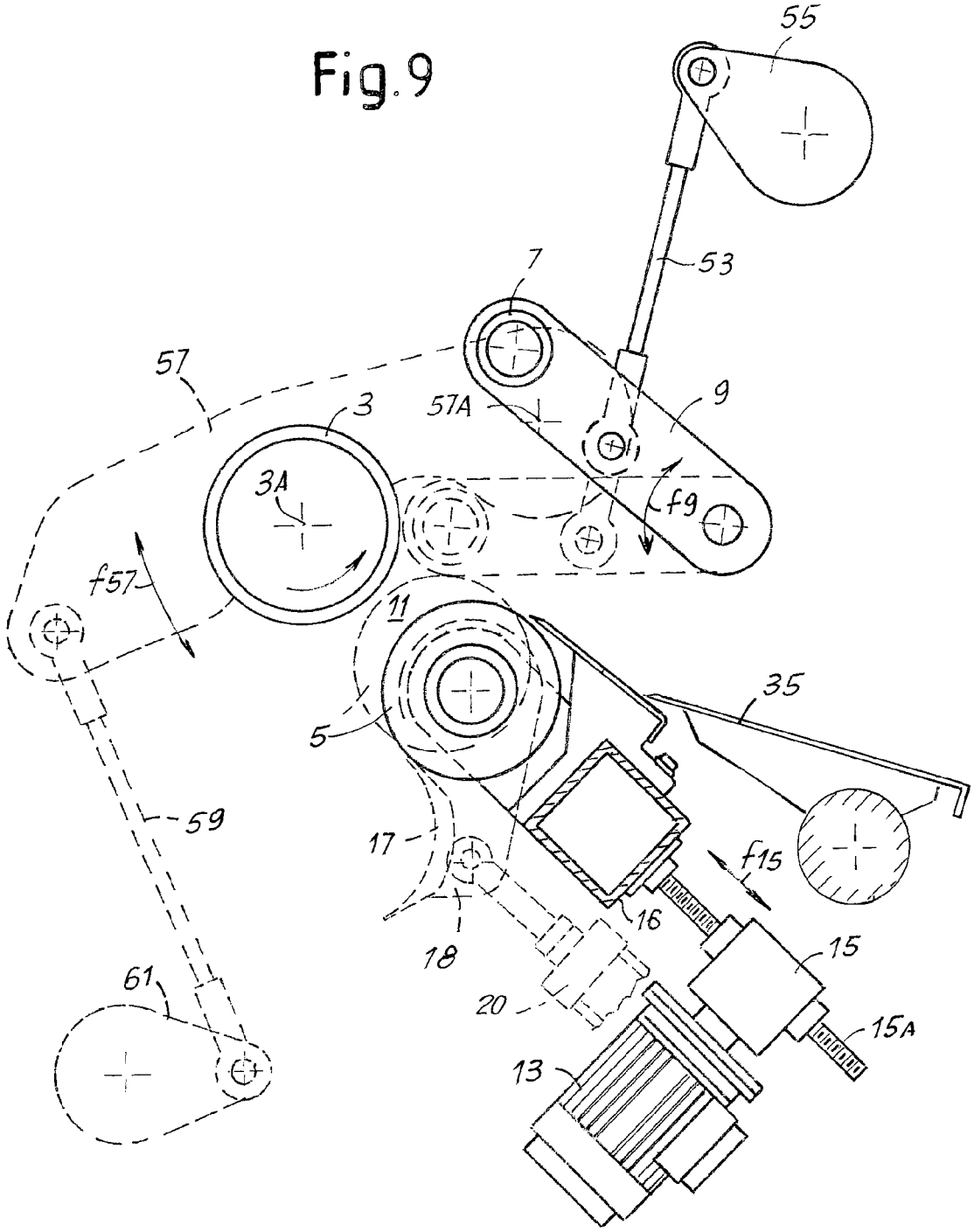
FIG. 9 shows a diagram illustrating the movements of the winding rollers.

FIG. 9 schematically shows the members that enable the translation or oscillation movements of the axes of the winding rollers 3, 5 and 7 to be imparted. In particular, the figure shows the motor 13 that controls the movement according to f15 to move the winding roller 5 toward or away from the winding roller 3. The reciprocal rotation movement according to f9 of the arms 9 that carry the third winding roller 7, to enable the roller 7 to move toward or away from the rollers 3 and 5 is imparted by a pair of connecting rods 53 articulated to a pair of cranks 55 advantageously controlled, for example, by an electronically controlled electric motor, not visible. In some embodiments the position of the axis 3A of the winding roller 3 can also be controlled. For this purpose the winding roller 3 can be supported by arms 57, articulated in 57A. Through connecting rods 59 articulated to cranks 61, with an electronically controlled electric motor or other suitable actuator, the controlled rotation movement according to the arrow f57 is imparted to the arms 57 and therefore to the rotation axis 3A of the winding roller 3 about the hinge axis 57A. The movement of the rotation axis 3A of the winding roller 3 can be used, for example, to recover the slack of the web material N, to adjust the dimension of the nip 11 between the winding rollers 3 and 5, to modify or adjust the dimension of the channel 19 between the winding roller 3 and the concave plate 17 or the concave cradle 41, or for other operating or adjustment needs.

Figure 10:
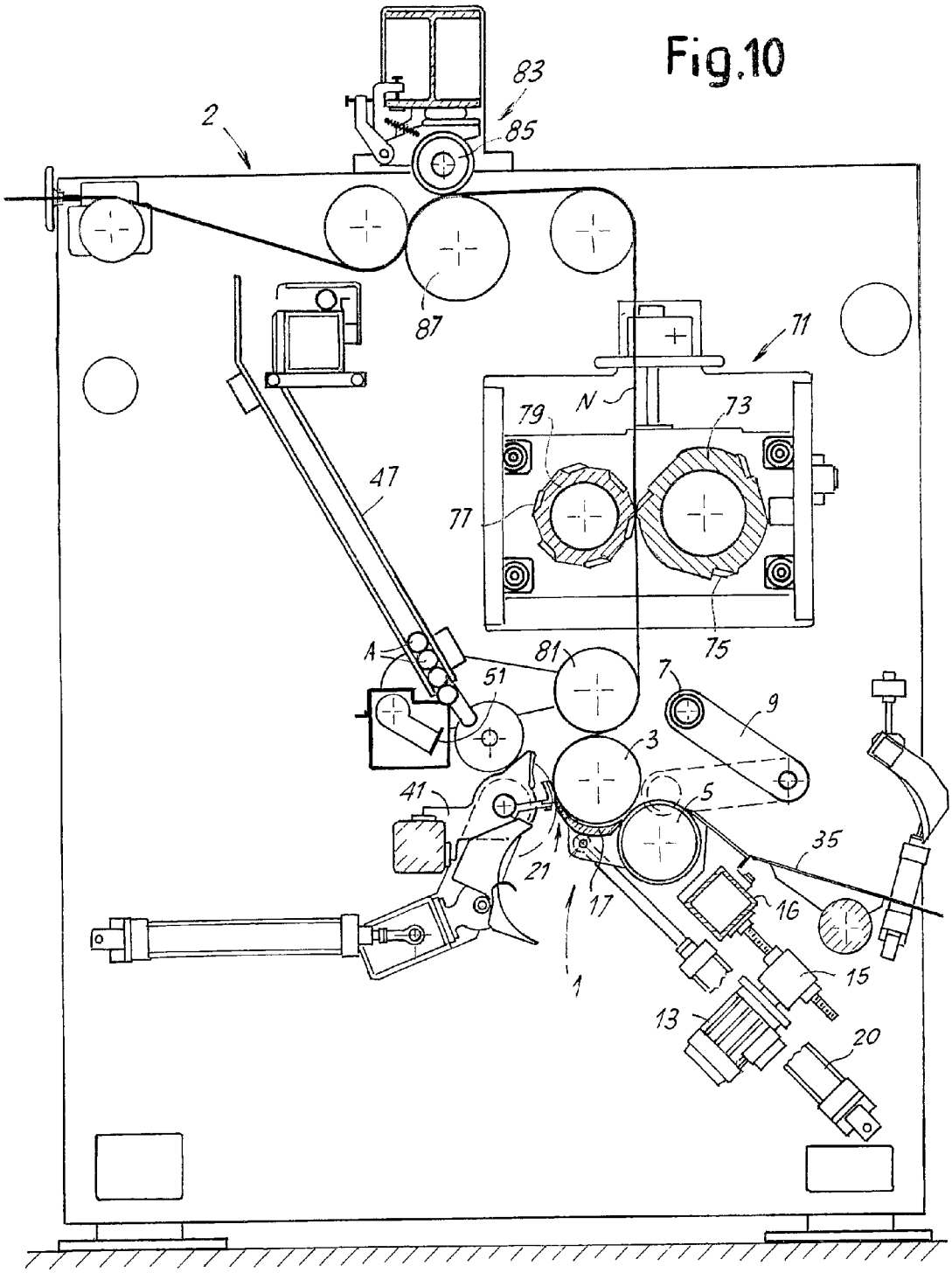
FIG. 10 shows a side view and partial section according to a vertical plane of a rewinding machine in a second embodiment.

FIG. 10 shows a modified embodiment of the machine according to the invention. The same reference numbers indicate the same or equivalent parts to those described above. The rewinding machine, indicated as a whole with 2, is shown in FIG. 1 complete with the other members not represented in FIGS. 1 to 9. In particular, the components positioned upstream of the winding head 1 are shown. Reference numeral 71 indicates the perforator unit. In some embodiments, the perforator unit 71 comprises a beam 73 supporting one or more blades 75 cooperating with blades 77 carried by a rotating roller 79. The web material N passes between the beam 73 and the roller 79 to be perforated along transverse perforation lines. Downstream of the perforator 71 a guide roller 81 is arranged, from which the web material is transferred to the first winding roller 3.

In this exemplary embodiment, upstream of the perforator unit 71 a ply-bonding unit 83 is arranged, of a type known per se and not described in greater detail herein. The unit 83 generally comprises a series of ply-bonding wheels 85 cooperating with a counter-pressure roller 87.

With regard to the winding head, the differences between the embodiment of FIGS. 10 to 14 and the embodiment of FIGS. 1 to 9 are as follows. The concave plate 17 has a greater extension, i.e. extends for a greater length around the cylindrical surface of the first winding roller 3 upstream of the nip 11 between the winding rollers 3 and 5. The moving member 21 is hinged about an axis 21C which is in a different position with respect to the position shown in FIGS. 1 to 9. In fact, in these latter the rotation axis 21C of the moving member 21 is located under the first winding roller 3, while in FIGS. 10 to 14 the rotation axis 21C of the moving member 21 is positioned beside the winding roller 3, on the opposite side with respect to the third winding roller 7.

Moreover, in this embodiment the concave cradle 41 is supported rotating about the rotation axis 21C of the moving member 21. Therefore, it passes from an idle position (FIGS. 10 to 12) to an operating position (FIG. 14) pivoting about the rotation axis 21C. Pivoting is controlled by a piston-cylinder actuator 42.

Figure 14:
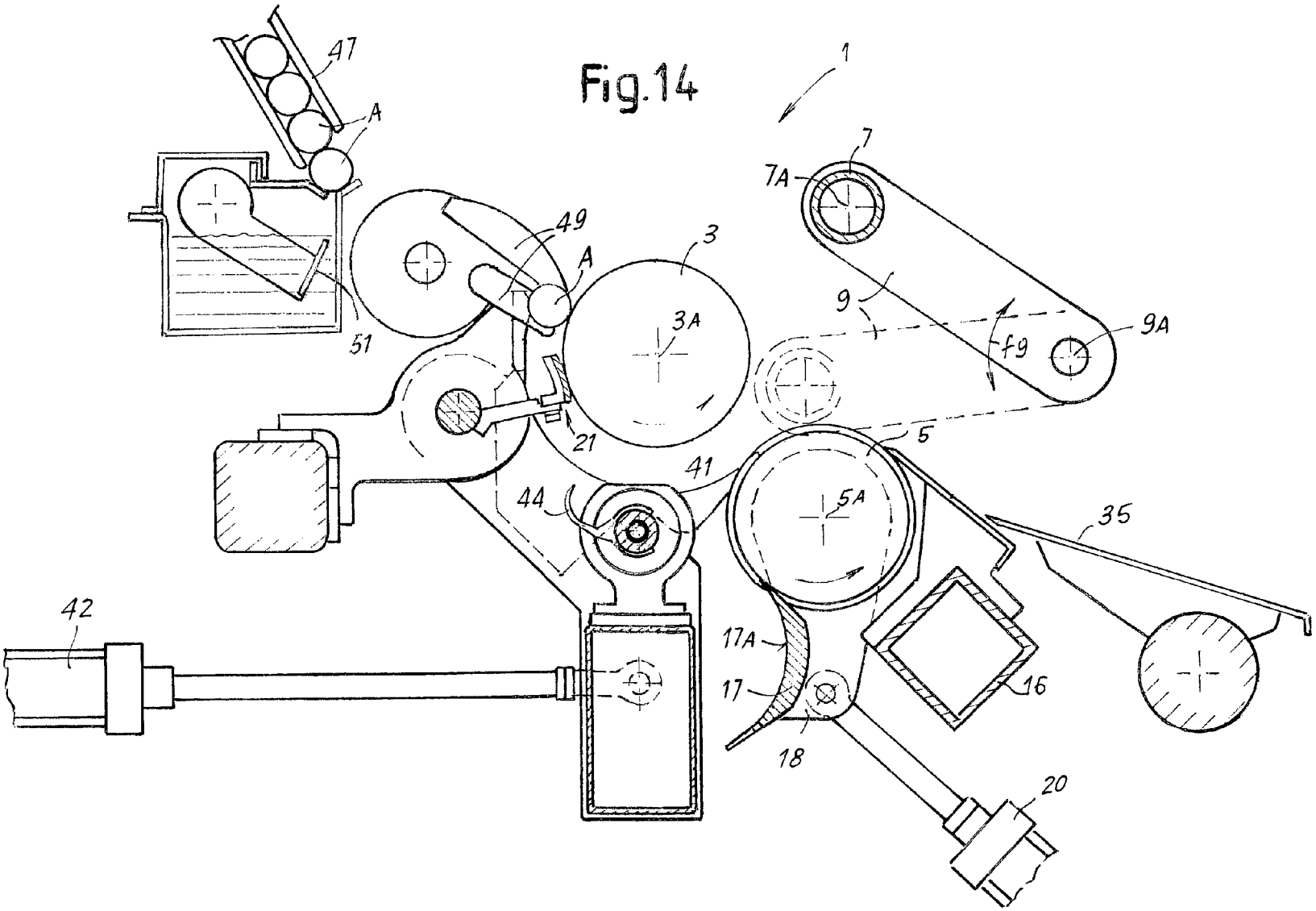
FIG. 14 shows a view similar to the FIGS. 11, 12 and 13 with the rewinder in the arrangement for producing logs with a winding core or winding mandrel.

In some embodiments a mechanical member 44 can also be provided, to facilitate the start of winding of the web material N around winding cores when the rewinding machine is in the arrangement of FIG. 14. Operation of the member 44 will not be described in greater detail as it is known per se and greater details of the operation and structure thereof can be found in publication US-A-2009/0272835. The auxiliary member can be used in alternative to the application of glue. The machine can be provided with the member 44 only without the glue applicator, or can comprise both to operate alternatively without or without glue. In other embodiments the member 44 can be omitted and the machine can be designed to operate exclusively with the glue.

Figure 11:
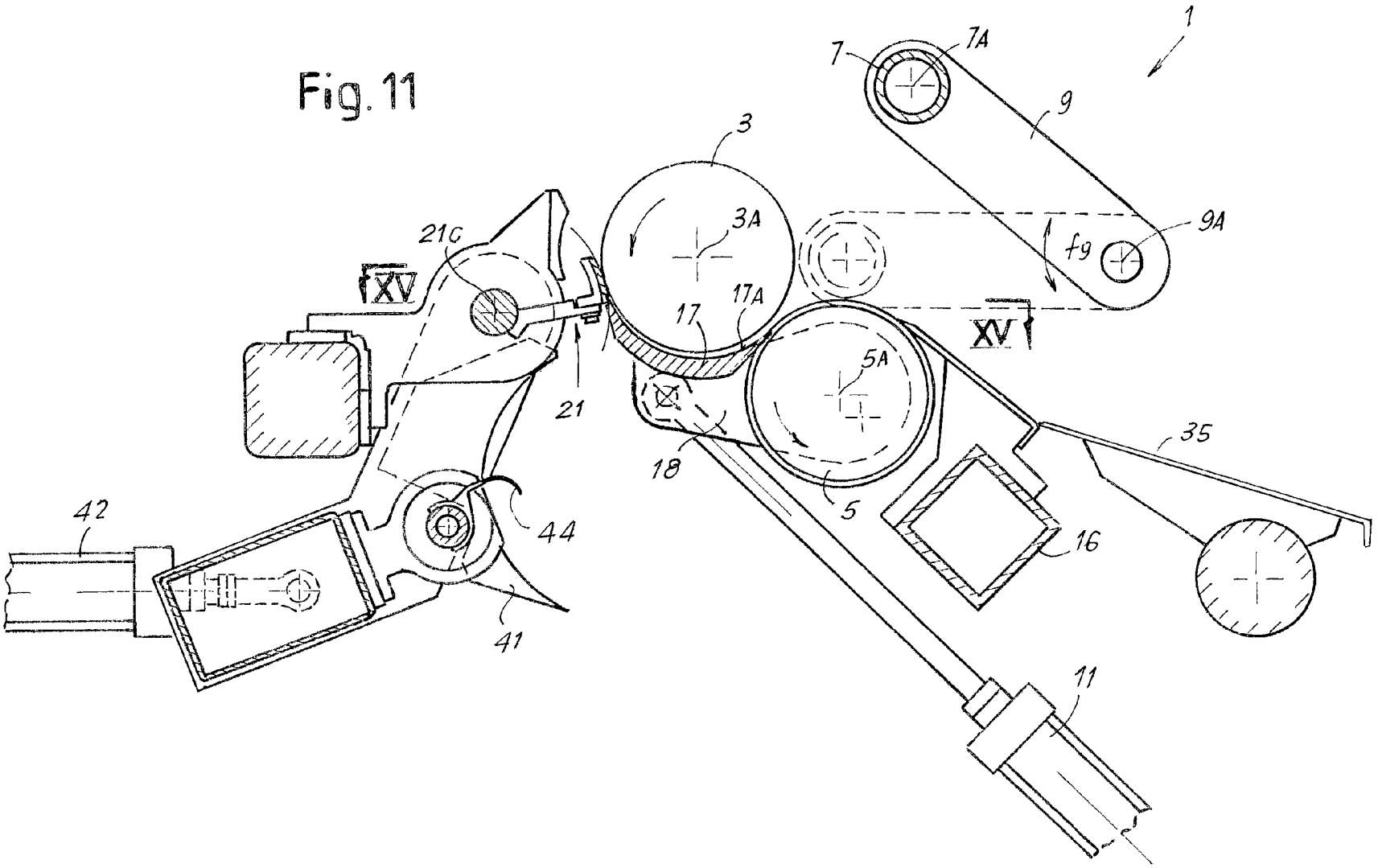
FIG. 11 shows a side view and partial section of a part of the rewinder of FIG. 10 in an operating mode for producing logs without winding core.
Figure 12:
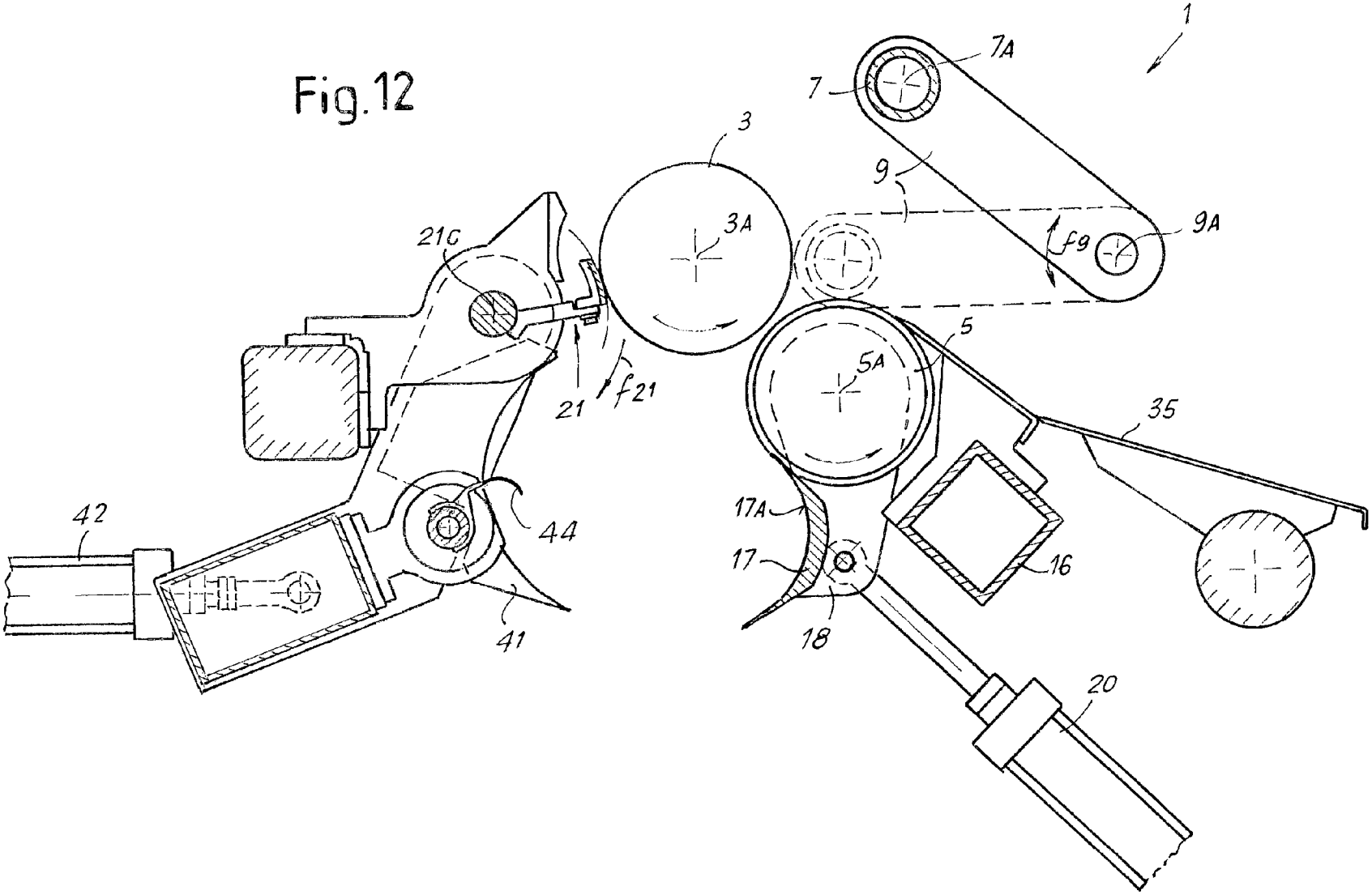
FIG. 12 shows the step of transition of the rewinder of FIG. 11 from the operating arrangement for producing logs without winding core to the operating arrangement for producing logs with winding core.
Figure 13:
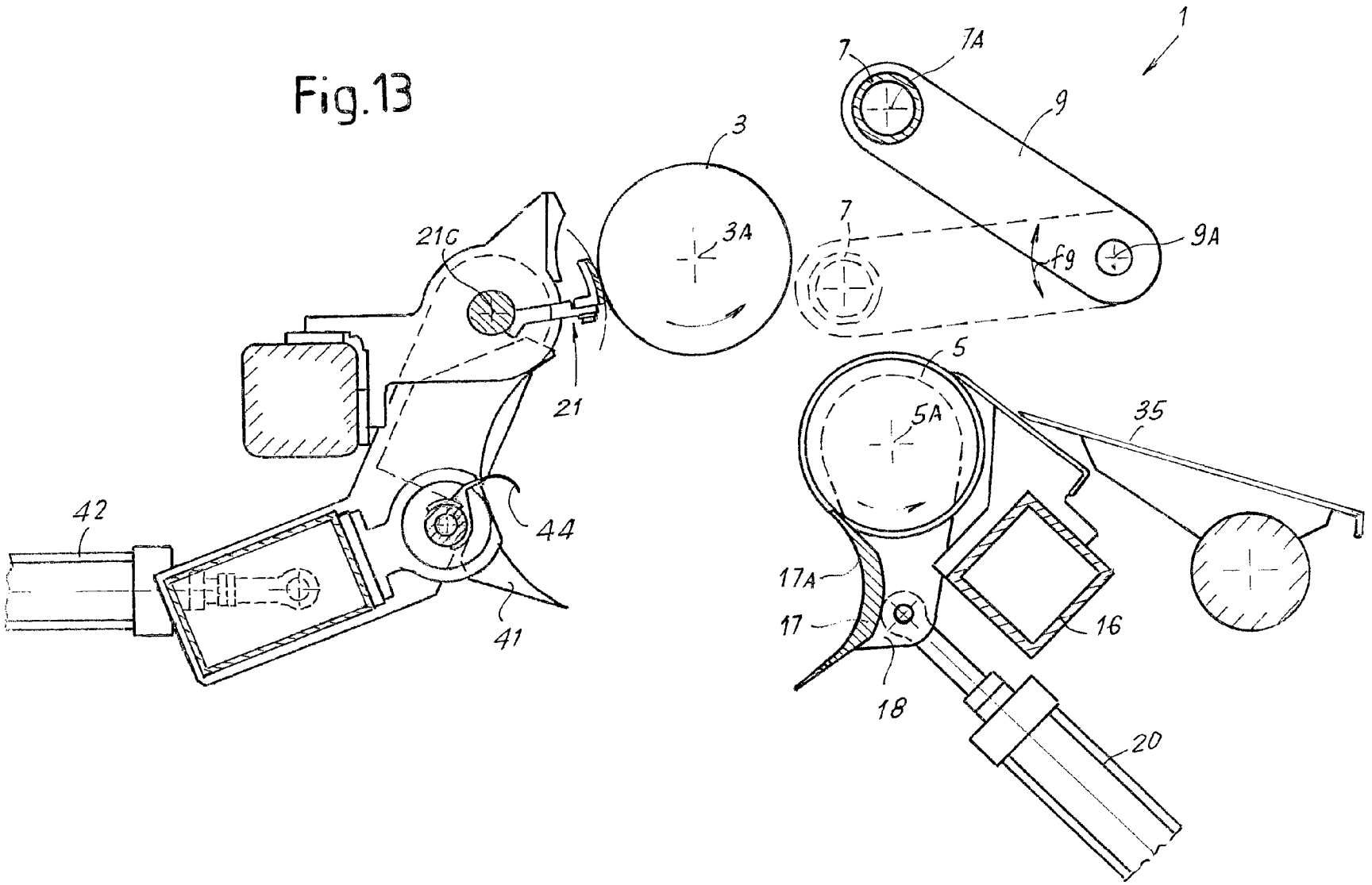
FIG. 13 shows a step of modifying the operating arrangement subsequent to the one shown FIG. 12.
Figure 15:
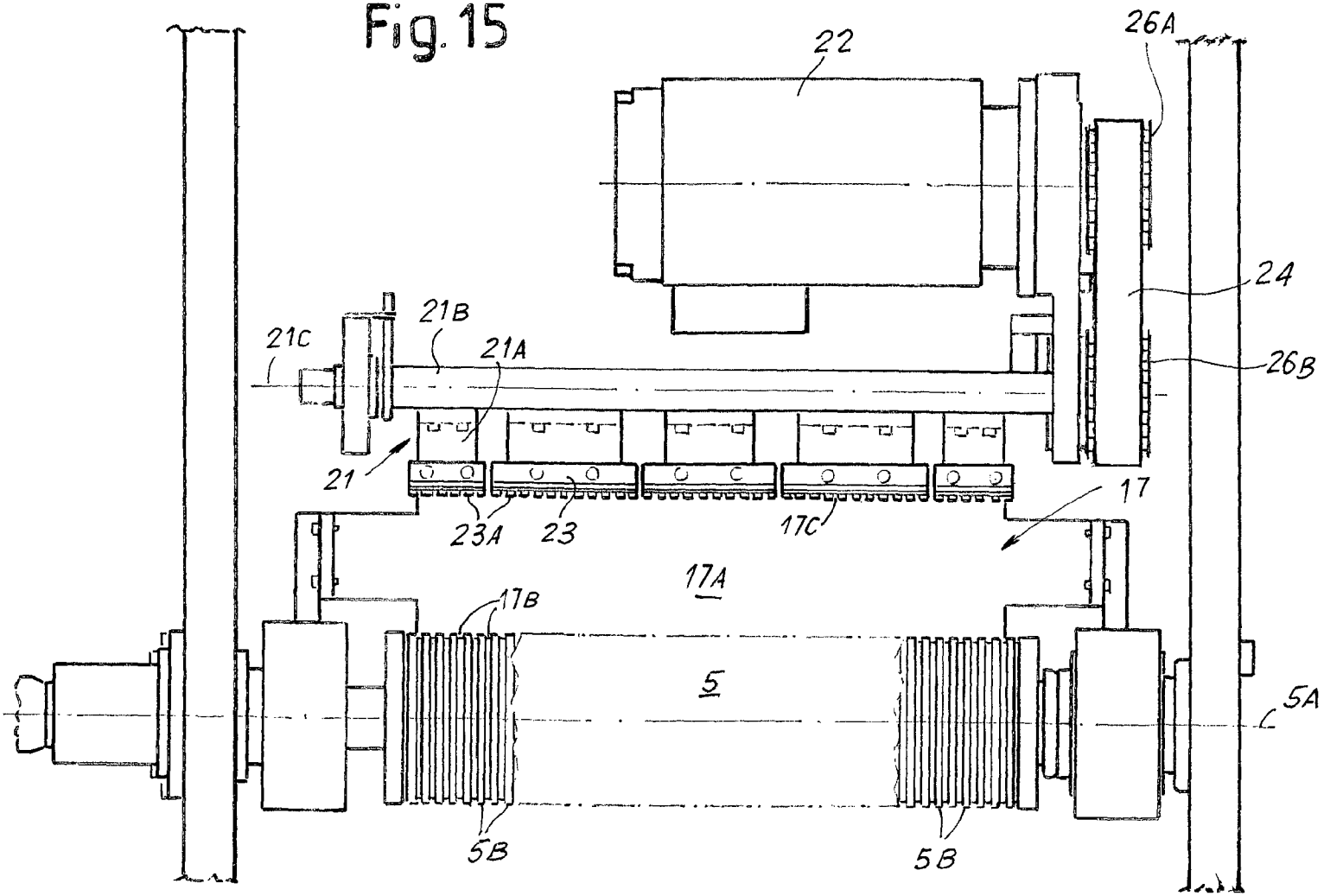
FIG. 15 shows a section, according to several mutually intersecting planes, of the severing member, of the concave plate and of the second winding roller according to the line XV-XV of FIG. 11.

FIG. 15 shows a section of the moving member 21 and of the second winding roller 5 along line XV-XV in FIG. 11. FIG. 15 shows the various components described above as well as an electric motor 22 for driving the moving member 21. Motion is transmitted from the motor 22 to the moving member 21 through a toothed belt 24 guided around toothed pulleys 26A, 26B.

Figure 16:
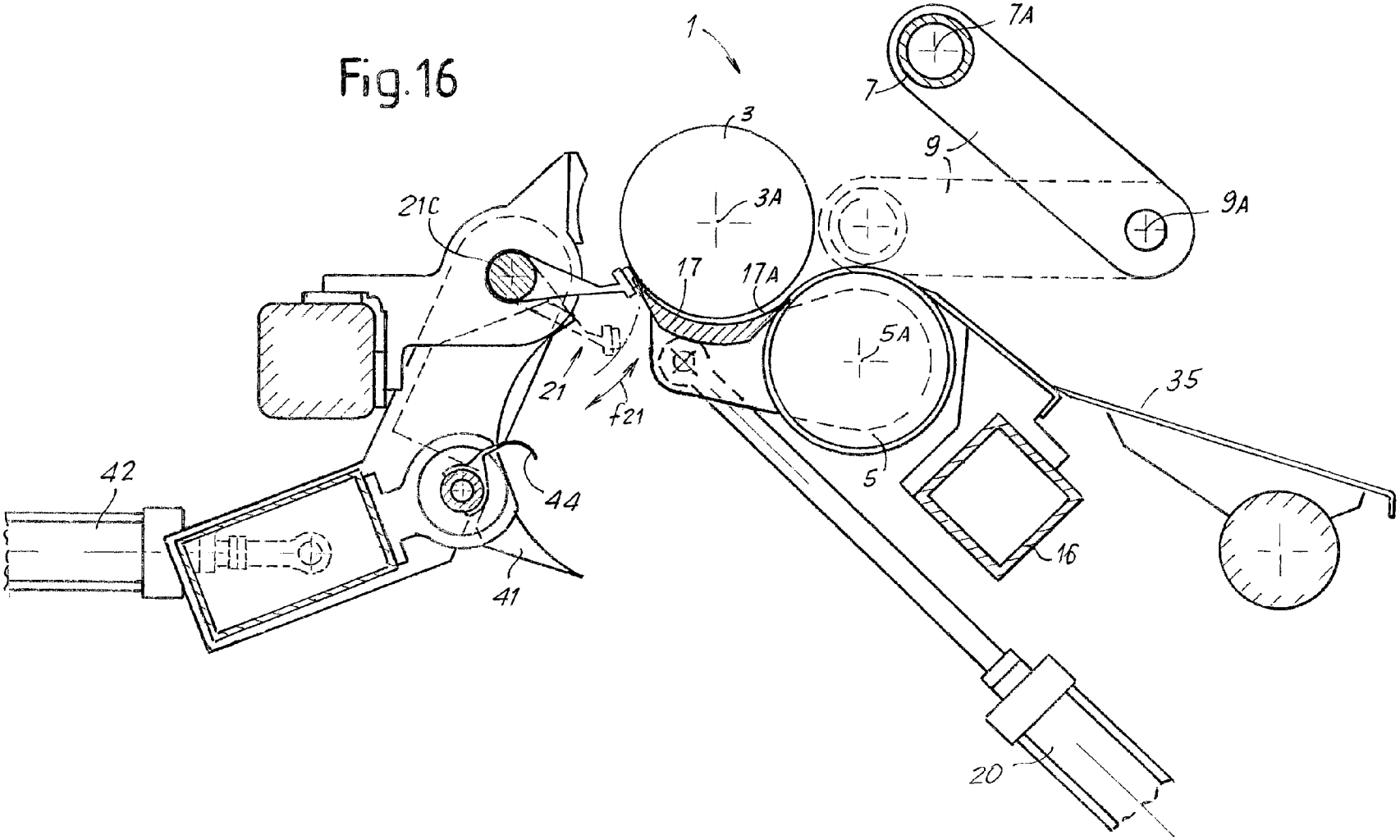
FIG. 16 shows a modified embodiment of the rewinding machine according to the invention.

FIG. 16 shows a modified embodiment with respect to the embodiment shown in FIGS. 10 to 15. The difference between this embodiment and the previous one consists in the different shape of the moving member 21 and the different type of movement it performs.

In FIG. 16 the moving member 21 is not provided with a rotation movement around an axis 21C, but with a reciprocating oscillatory or rotary movement around said axis, as indicated by the double arrow f21. The moving member 21 rotates in counter-clockwise direction (in the figure) to come into contact with the web material N and pinch it against the cylindrical surface of the winding roller 3 and perform severing of the web material. Subsequently, it reverses its rotation movement to return to the position shown with a broken line in FIG. 15 and during the reverse movement accompanies the initial central nucleus of the new log L1 toward the channel 19 formed also in this case between the winding roller 3 and the concave surface 17A of the concave plate 17. The moving member 21 in this configuration can be designed and controlled as described in Italian patent application n. FI2010A000025 and in the corresponding international application PCT/IT2011/000037, the content of which is incorporated in the present description.

Both the moving member 21 of FIG. 16, and the member 21 of the embodiment shown in FIGS. 10 to 15 are provided with a series of projections similar to the projections 23A described with reference to FIGS. 1 to 9, cooperating with the comb edge 17C of the plate 17, to enable transfer of the initial nucleus of the log L1 toward the channel 19.

It is understood that the drawing shows just one example, provided merely as a practical demonstration of the invention, which can vary in its forms and arrangements, without however departing from the scope of the concept underlying the invention. Any reference numbers in the appended claims are provided to facilitate reading of the claims with reference to the description and to the drawing, and do not limit the scope of protection represented by the claims.

The invention claimed is:

1. A rewinding machine for producing logs of web material, comprising a first winding roller; a concave plate facing the first winding roller, said first winding roller and said concave plate defining a feed channel for web material; a feed path of the web material extending along said channel; upstream of said concave plate, a moving member having a pinching surface structured to cooperate with said first winding roller to pinch the web material against the first winding roller; wherein said moving member is arranged and controlled to pinch the web material against a surface of the first winding roller and decelerate the web material between the moving member and the surface of the first winding roller to cause a leading edge of the web material to wind around itself to form a winding nucleus of a log.

2. The rewinding machine as claimed in claim 1, wherein said moving member is arranged and controlled to cause severing of the web material before the leading edge winds around itself after severing.

3. The rewinding machine as claimed in claim 1, further comprising a second winding roller, wherein a nip is defined between said first winding roller and said second winding roller, said concave plate extends upstream of said nip, and said feed path for feeding the web material extends through said nip.

4. The rewinding machine as claimed in claim 1, wherein a peripheral winding cradle is arranged downstream of said concave plate.

5. The rewinding machine as claimed in claim 1, wherein said moving member is controlled so that the pinching surface has a speed which, when said pinching surface is pressed against said first winding roller, is lower than peripheral speed of the first winding roller.

6. The rewinding machine as claimed in claim 1, wherein said concave plate defines an inlet edge which cooperates with said moving member to form a transfer surface for rolling of an initial winding nucleus of a log from the moving member to said concave plate.

7. The rewinding machine as claimed in claim 1, wherein said first winding roller comprises a lateral surface defining a longitudinal projection, extending parallel to an axis of said first winding roller and protruding radially with respect to a cylindrical surface of the first winding roller.

8. The rewinding machine as claimed in claim 7, wherein adjacent to said longitudinal projection and behind the longitudinal projection with respect to direction of rotation of the web material, said first winding roller has a first lateral surface portion with a diameter gradually decreasing from said projection and terminating tangentially to a cylindrical surface defining a second lateral surface portion of the first winding roller, said cylindrical surface defining said second lateral surface portion of the winding roller having a substantially constant radius.

9. The rewinding machine as claimed in claim 7, wherein said first winding roller comprises, on the lateral surface and in proximity of said longitudinal projection, at least one suction aperture.

10. The rewinding machine as claimed in claim 9, wherein said suction aperture is structured as a slit extending parallel to the axis of the first winding roller and to said longitudinal projection.

11. The rewinding machine as claimed in claim 10, further comprising in said first winding roller, a first removable block and a second removable block, wherein said second removable block is arranged in said first winding roller adjacent to said first removable block and behind said first removable block with respect to a direction of rotation of the first winding roller, and wherein said suction aperture is formed between adjacent edges of said first removable block and of said second removable block.

12. The rewinding machine as claimed in claim 7, wherein said longitudinal projection is formed on a first removable block secured in a seat in the first winding roller.

13. The rewinding machine as claimed in claim 12, further comprising a second removable block arranged in said first winding roller adjacent to said first removable block and behind said first removable block with respect to a direction of rotation of the first winding roller.

14. The rewinding machine as claimed in claim 13, wherein said second removable block has an external surface with a coefficient of friction higher than a coefficient of friction of an external surface of the first removable block.

15. The rewinding machine as claimed in claim 1, wherein said concave plate is movable between an operating position, in which said concave plate defines said feed channel of the web material, and an idle position, in which said concave plate is placed at a distance from the first winding roller.

16. The rewinding machine as claimed in claim 15, wherein said concave plate is movable between said operating position and said idle position with a movement of rotation about an axis of a second winding roller.

17. The rewinding machine as claimed in claim 1, comprising a concave cradle positionable facing said first winding roller, rather than said concave plate, said concave cradle having a larger radius of curvature than a radius of curvature of said concave plate.

18. The rewinding machine as claimed in claim 17, wherein said concave cradle is movably mounted to alternatively be in an operating position, in which said concave cradle is arranged facing the first winding roller to define a feed channel of the web material, and an idle position.

19. The rewinding machine as claimed in claim 1, wherein said moving member has a movement separate from said concave plate.

20. The rewinding machine as claimed in claim 1, wherein the leading edge is caused to start winding around itself in a position between the first winding roller and the moving member and is passed from said position between the first winding roller and the moving member to a position between the moving member and the concave plate.

21. A rewinding machine for producing logs of web material, comprising a first winding roller; a concave plate facing the first winding roller, said first winding roller and said concave plate defining a feed channel for web material; a feed path of the web material extending along said channel; upstream of said concave plate, a moving member having a pinching surface structured to cooperate with said first winding roller to pinch the web material against the first winding roller; wherein said moving member is arranged and controlled to pinch the web material against a surface of the first winding roller and decelerate the web material between the moving member and the surface of the first winding roller to cause a leading edge of the web material to wind around itself to form a winding nucleus of a log; wherein said concave plate defines an inlet edge which cooperates with said moving member to form a transfer surface for rolling of an initial winding nucleus of a log from the moving member to said concave plate; and wherein said inlet edge of the concave plate has a comb structure cooperating with a plurality of projections of said moving member, said projections penetrating the comb structure at the inlet edge of the concave plate.

22. A rewinding machine for producing logs of web material, comprising a first winding roller; a concave plate facing the first winding roller, said first winding roller and said concave plate defining a feed channel for web material; a feed path of the web material extending along said channel; upstream of said concave plate, a moving member having a pinching surface structured to cooperate with said first winding roller to pinch the web material against the first winding roller; wherein said moving member is arranged and controlled to pinch the web material against a surface of the first winding roller and decelerate the web material between the moving member and the surface of the first winding roller to cause a leading edge of the web material to wind around itself to form a winding nucleus of a log; wherein said concave plate defines an inlet edge which cooperates with said moving member to form a transfer surface for rolling of an initial winding nucleus of a log from the moving member to said concave plate; and wherein said inlet edge of the concave plate has a comb structure cooperating with a plurality of projections of said moving member, said projections penetrating the comb structure at the inlet edge of the concave plate, and wherein said projections form said pinching surface of the moving member.

23. A method for winding logs of web material without a winding core, with a rewinding machine comprising a first winding roller; a concave plate facing the first winding roller, said first winding roller and said concave plate defining a feed channel for web material; a feed path of the web material extending along said channel; upstream of said concave plate, a moving member having a pinching surface structured to cooperate with said first winding roller to pinch the web material against the first winding roller; wherein said moving member is arranged and controlled to pinch the web material against a surface of the first winding roller and decelerate the web material between the moving member and the surface of the first winding roller to cause a leading edge of the web material to wind around itself to form a winding nucleus of a log; said method comprising:

feeding a web material around said first winding roller;

winding a first log;

upon completion of winding of said first log, severing the web material by said moving member, forming a free trailing edge of the first log and a free leading edge of a second log;

winding an initial portion of said web material around itself, adjacent to said free leading edge, between a surface of the first winding roller and a surface of said moving member, forming an initial nucleus of said second log;

transferring said initial nucleus of the second log from the moving member to a channel defined between the first winding roller and the concave plate;

feeding said initial nucleus of the second log by rolling said initial nucleus along said channel in contact with said concave plate and said first winding roller, and continuing to wind the web material around said initial nucleus.

24. The method as claimed in claim 23, wherein said severing of the web material is by said moving member as a result of decelerating the web material in an area between the moving member and the first winding roller wherein said severing occurs due to pinching of the web material between the moving member and the first winding roller.

25. The method as claimed in claim 23, further comprising transferring said initial nucleus of the second log from the channel to a nip defined between said first winding roller and a second winding roller.

26. The method as claimed in claim 25, further comprising feeding said initial nucleus of the second log through said nip toward a winding cradle downstream of said nip and continuing winding of the second log in said winding cradle.

27. The method as claimed in claim 23, wherein during said severing of the web material and starting formation of said initial nucleus of the second log, maintaining the concave plate substantially stationary and moving the moving member toward the concave plate.

28. The method as claimed in claim 23, further comprising retaining the web material by suction on the first winding roller in a vicinity of the leading edge.

29. The method as claimed in claim 23, further comprising adjusting height of said channel during rolling of the initial nucleus of the second log along said channel.

30. The method as claimed in claim 23, further comprising defining, between said moving member and said first winding roller, a space to start winding of said initial nucleus and gradually increasing said space to allow increase in diameter of the initial nucleus until said transferring of the initial nucleus to said channel.

31. The method as claimed in claim 30, wherein said space is defined between a pinching surface of said moving member and a portion of cylindrical surface with non-circular cross section of the first winding roller, said portion of cylindrical surface having a gradually decreasing diameter.

* * * * *